United States Patent [19]

Marin et al.

[11] Patent Number: 4,598,289

[45] Date of Patent: Jul. 1, 1986

[54] CONTROL DEVICE FOR A SYNCHRO RECEIVER

[75] Inventors: Guy F. M. Marin, Boulogne; Serge Hethuin, Meudon, both of France

[73] Assignee: U.S. Philips Corporation, New York, N.Y.

[21] Appl. No.: 510,092

[22] Filed: Jul. 1, 1983

[30] Foreign Application Priority Data

Jul. 2, 1982 [FR] France ..... 82 11640

[51] Int. Cl.[4] ..... G09F 13/36

[52] U.S. Cl. ..... 340/870.34; 340/315; 340/318; 318/654; 318/661; 318/690

[58] Field of Search ..... 340/870.34, 315, 316, 340/317, 318, 870.25; 318/654, 655, 661, 690, 692; 33/317 R, 361; 328/133, 143

[56] References Cited

U.S. PATENT DOCUMENTS 3,639,850 2/1972 Brook ..... 328/133
4,360,889 11/1982 Liedtke ..... 328/133
4,418,480 12/1983 Garner ..... 33/361

FOREIGN PATENT DOCUMENTS 2011655 7/1979 United Kingdom ..... 340/318

*Primary Examiner*—Gerald L. Brigance
*Assistant Examiner*—Mahmoud Fatahi-Yar
*Attorney, Agent, or Firm*—Robert T. Mayer; Bernard Franzblau

[57] ABSTRACT

A control device suitable for synchros comprising three stator windings. The device comprises four circuit branches with the inputs of the first and the second branches interconnected to receive a first voltage from the ends of the stator windings of the synchro transmitter and with the inputs of the third and the fourth branches interconnected to receive a second voltage from the ends of the stator windings of the synchro transmitter. Two adder elements supply control voltages to the stator windings of the synchro receiver. Two inputs of the first adder are connected to the outputs of the first and the third branches, respectively and the two inputs of the secnd adder are connected to the outputs of the second and the fourth branches. These branches have transfer functions in the form sin $(\alpha+\phi 1)$, sin $(\alpha+\phi 2)$, sin $(\alpha+\phi 3)$, sin $(\alpha+\phi 4)$, respectively, wherein $\alpha$ represents the information supplied by a digital element and $\phi 1$, $\phi 2$, $\phi 3$, $\phi 4$ represent the differentphase shift angles. Used to display the position on the instrument panel of aeroplanes.

9 Claims, 2 Drawing Figures

CONTROL DEVICE FOR A SYNCHRO RECEIVER

The present invention relates to a control device for a synchro receiver for data supplied on the one hand by a synchro transmitter and on the other hand by a digital element, the said synchros comprising three stator windings.

It should be noted that the synchros involved here are predominantly used for the transmission of angular data. A description of the synchro apparatus can be found in the prior art.

By using this type of apparatus it is possible to control a display which depends on two quantities, these quantities being produced by apparatus of the same type. It increasingly happens that the quantities are processed by digital means such as, for example, microprocessor systems. This poses a difficult problem when one of the quantities is supplied by a digital element and the display must be effected by the synchro. This problem occurs more specifically in air radio navigation systems in which an aeroplane determines its position relative to a beacon. Aboard this aeroplane there is a more or less sophisticated equipment which supplies the bearing in digital form. This angle indicates, with respect to the aeroplane, the angular distance between the magnetic north pole and the beacon. A simpler equipment supplies the course. This angle is simply processed by a synchro which is coupled to a compass. The necessary remote display must be effected by a synchro and must indicate the position, the difference between the above-mentioned angles (the bearing and the course).

An object of the present invention is to provide a solution to this important problem.

To that end, a device of the type mentioned in the opening paragraph is characterized in that it comprises, on the one hand, four branches with the inputs of the first and the second branches being interconnected to receive a first voltage from the ends of the stator windings of the synchro transmitter. The inputs of the third and the fourth branches are interconnected to receive a second voltage from the ends of the stator of the synchro transmitter. In order to supply control voltages to the winding ends of the stator of the synchro receiver, the device comprises, on the other hand, two adders. Two inputs of the first adder are connected to the output of the first and the third branches, respectively and the two inputs of the second adder are connected to the outputs of the second and the fourth branches. Each of these branches have a transfer function of the form sin $(\alpha+\phi 1)$, sin $(\alpha+\phi 2)$, sin $(\alpha+\phi 3)$, sin $(\alpha+\phi 4)$, respectively, wherein $\alpha$ represents the information supplied by the digital element and $\phi 1$, $\phi 2$, $\phi 3$, $\phi 4$ the different phase shift angles.

The following description is given by way of non limitative example with reference to the accompanying drawings and will make it clear how the invention can be put into effect.

The following description is based on the application of the invention which was already mentioned above by way of example, that is to say the case in which one wants to display the position as a function of the course and the bearing.

Figure 1:
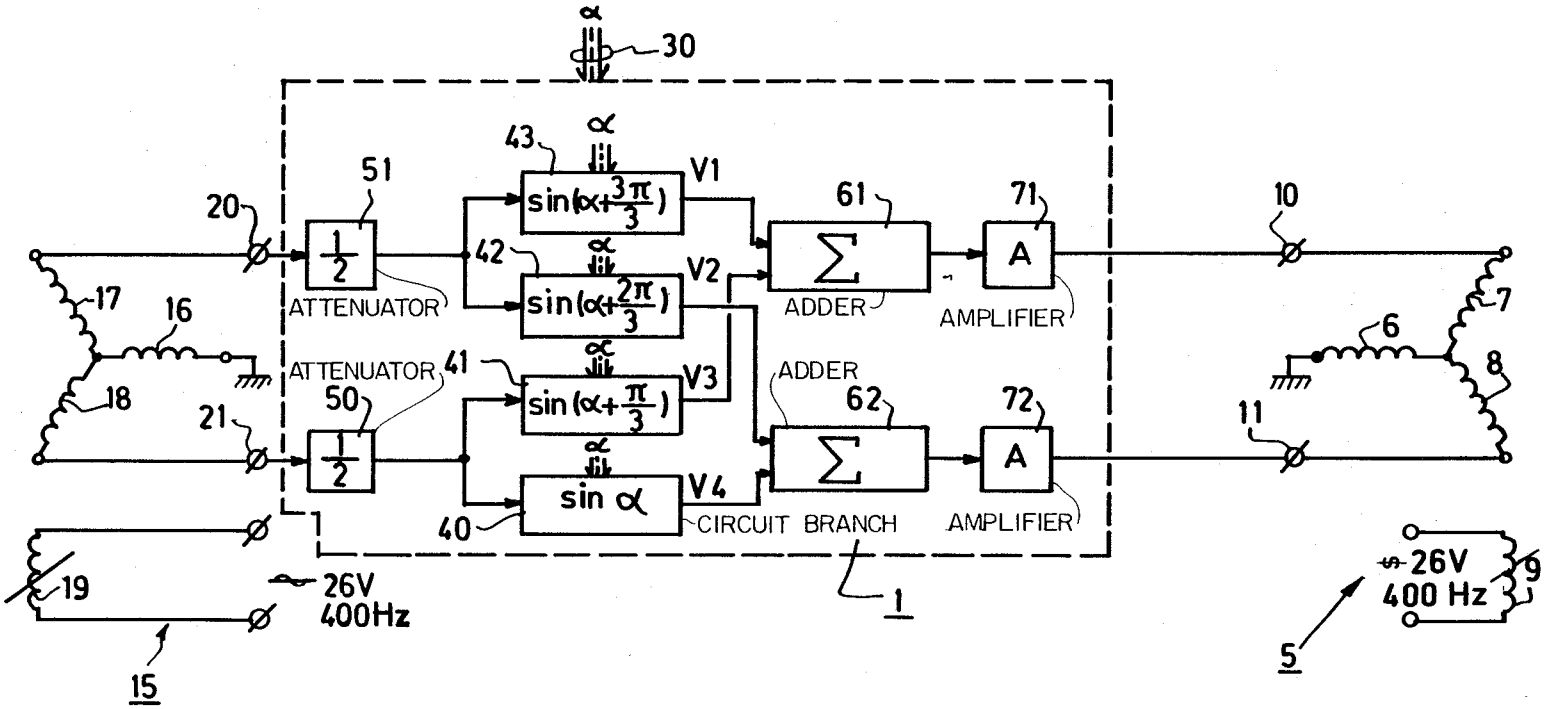
FIG. 1 shows a device in accordance with the invention.

In FIG. 1, the device according to the invention is denoted by reference numeral 1. The synchro receiver used to display the position is denoted by reference numeral 5. The Figure shows its three stator windings 6, 7 and 8 and a rotor winding 9. The first end of the stator windings are interconnected. The second end of the winding 6 is connected to ground, while the second ends of the windings 7 and 8, respectively, are connected to the input terminals 10 and 11, so that the voltages for controlling the angular rotation of the rotor provided with the winding 9 occur between the terminals 10 and 11 and ground. The synchro transmitter which supplies the course information ($\theta$) is denoted by reference numeral 15. The stator windings are denoted by reference numerals 16, 17 and 18, and the rotor winding by reference numeral 19. A voltage source producing an a.c. voltage of 26 Volts and having a frequency of 400 Hz is permanently applied to the ends of the rotors 9 and 19. The first end of the windings 16, 17 and 18 are interconnected. The second end of the winding 16 is connected to ground, while the second ends of the windings 17 and 18 are connected to the output terminals 20 and 21, respectively so that the voltages supplied by the synchro 15 appear between the terminals 20 and 21 and ground. The device 1 also has an input terminal 30 for receiving digital information which defines the bearing ($\alpha$).

In the above-mentioned use, the device is provided to apply a voltage V10 between the terminal 10 and ground so that:

$$V10 = V0 \sin\left(\alpha - \theta + \frac{2\pi}{3}\right)$$

and a voltage V11 between terminal 11 and ground, $$V11 = V0 \sin\left(\alpha - \theta + \frac{\pi}{3}\right)$$

These voltages will cause the rotor of the synchro to rotate through an angle $\gamma$ which is the angular position:

$$\gamma = \alpha - \theta$$

This can be derived as follows. Associated with the angular course $\theta$ there is on the one hand a voltage V20 between the terminal 20 and ground and a voltage V21 between the terminal 21 and ground so that:

$$V20 = V0 \sin\left(\theta - \frac{\pi}{3}\right)$$

$$V21 = V0 \sin\left(\theta - \frac{2\pi}{3}\right)$$

V0 being a constant which represents the maximum amplitude of the voltages.

In accordance with the invention, four branches 40, 41, 42 and 43 are provided. The inputs of the branches 40 and 41 are connected to the terminal 21 via an attenuator 50 which produces an attenuation by a factor $\frac{1}{2}$. The inputs of the branches 42 and 43 are connected to the terminal 20 via an attenuator 51 which also produces an attenuation of a factor $\frac{1}{2}$. A first adder element 61 adds together the voltages V1 and V3 which appear at the outputs of the branches 43 and 41. A second adder element 62 adds together the voltages V2 and V4, which appear at the outputs of the branches 42 and 40. The output voltages of the elements 61 and 62 are applied to the terminals 10 and 11 via amplifiers 71 and 72 having a gain $(-4/\sqrt{3})$. The branches 40, 41, 42, 43 have the following respective transfer function:

$$\sin\left(\alpha + \frac{\pi}{3}\right)$$

$$\sin\left(\alpha + \frac{2\pi}{3}\right)$$

$$\sin\left(\alpha + \frac{3\pi}{3}\right)$$

To explain the operation of the device in accordance with the invention it is sufficient to write:

$$V1/V0 = +\tfrac{1}{2}\sin\left(\theta - \frac{\pi}{3}\right)\sin\left(\alpha + \frac{3\pi}{3}\right)$$

$$= -\tfrac{1}{4}\left[\cos\left(\alpha + \theta + \frac{2\pi}{3}\right) - \cos\left(\alpha - \theta + \frac{4\pi}{3}\right)\right].$$

$$V2/V0 = +\tfrac{1}{2}\sin\left(\theta - \frac{\pi}{3}\right)\sin\left(\alpha + \frac{2\pi}{3}\right)$$

$$= -\tfrac{1}{4}\left[\cos\left(\alpha + \theta + \frac{\pi}{3}\right) - \cos\left(\alpha - \theta + \frac{3\pi}{3}\right)\right].$$

$$V3/V0 = +\tfrac{1}{2}\sin\left(\theta - \frac{2\pi}{3}\right)\sin\left(\alpha + \frac{\pi}{3}\right)$$

$$= -\tfrac{1}{4}\left[\cos\left(\alpha + \theta - \frac{\pi}{3}\right) - \cos\left(\alpha - \theta + \frac{3\pi}{3}\right)\right].$$

$$V4/V0 = +\tfrac{1}{2}\sin\left(\theta - \frac{2\pi}{3}\right)\sin\alpha$$

$$= -\tfrac{1}{4}\left[\cos\left(\alpha + \theta - \frac{2\pi}{3}\right) - \cos\left(\alpha - \theta + \frac{2\pi}{3}\right)\right].$$

Therefore:

$$4(V1 + V3)/V0 = \cos\left(\alpha - \theta + \frac{4\pi}{3}\right) + \cos\left(\alpha - \theta + \frac{3\pi}{3}\right) = 2\cos\left(\alpha - \theta + \frac{7\pi}{6}\right)\cos\frac{\pi}{6} = 2\sin\left(\alpha - \theta + \frac{7\pi}{6} + \frac{\pi}{2}\right)\frac{\sqrt{3}}{2}.$$

Hence:

$$4(V1 + V3)/\sqrt{3}\cdot V0 = \sin\left(\alpha - \theta + \frac{2\pi}{3} + \pi\right)$$

or $$-\frac{4}{\sqrt{3}\,V0}(V1 + V3) = \sin\left(\alpha - \theta + \frac{2\pi}{3}\right).$$

Similarly:

$$4(V2 + V4)/V0 = \cos\left(\alpha - \theta + \frac{3\pi}{3}\right) + \cos\left(\alpha - \theta + \frac{2\pi}{3}\right) = 2\cos\left(\alpha - \theta + \frac{5\pi}{6}\right)\cos\frac{\pi}{6} = 2\sin\left(\alpha - \theta + \frac{5\pi}{6} + \frac{\pi}{2}\right)\frac{\sqrt{3}}{2}.$$

Therefore:

$$4(V2 + V4)/\sqrt{3}\cdot V0 = \sin\left(\alpha - \theta + \frac{\pi}{3} + \pi\right);$$

or $$-\frac{4}{\sqrt{3}\,V0}(V2 + V4) = \sin\left(\alpha - \theta + \frac{\pi}{3}\right).$$

Hence:

$$V10 = kV0\sin\left(\alpha - \theta + \frac{2\pi}{3}\right),$$

and $$V11 = kV0\sin\left(\alpha - \theta + \frac{\pi}{3}\right),$$

wherein k is a proportionality factor. It is possible, when the gain of the amplifiers 71 and 72 is chosen to be equal to A, to obtain that k=1, that is to say:

$$A = \frac{-4}{\sqrt{3}}$$

Figure 2:
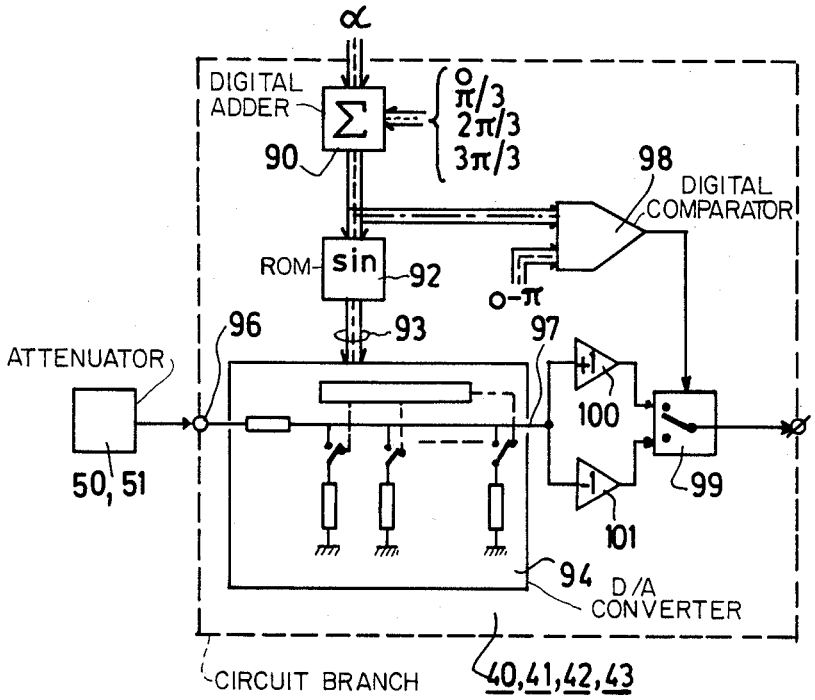
FIG. 2 shows in detail an embodiment of a branch which forms a part of the device of FIG. 1.

FIG. 2 shows a detailed embodiment of the branches 40, 41, 42, 43. These branches have identical structures, except for the angular value present at an input of a digital adder 90, whose other input receives the digital quantity $\alpha$. The displayed angular value corresponds to the different phase deviations 0, $\pi/3$, $2\pi/3$ and $3\pi/3$. The digital value at the output is applied to a "sine table" 92 in the form of, for example, a read-only memory. This memory supplies only the positive sine and this digital value is applied to the digital input 93 of a digital-to-analog converter 94 (for example the circuit AD 7524). The reference signal input 96 of this circuit is connected to the output of the circuit 50 for the branches 40 and 41 and to the output of the circuit 51 for the branches 42 and 43. The digital-to-analog converter is of the resistor type so that the signal at its output 97 is the product of the voltage applied to the input 96 and the code applied at its digital input 93. In order to change the sign of the voltage at the output 97 as a function of the angle at the input of the table 92 a digital comparator 98 is used which detects whether this angle is comprised within the interval 0 and $\pi$, or is outside this interval. As a function of this information supplied to the comparator 98, a change-over switch 99 is acted on to multiply by $+1$ or by $-1$ the signal at the output 97. This may be effected by two amplifiers 100 and 101 having a gain $+1$ and $-1$, respectively, which are connected between the output 97 and the input of the change-over switch 99. The four circuit branches 40, 41, 42, and 43 operate as four look-up tables. The output signal of each of the branches is dependent upon the input signal ($\alpha$), a predetermined and fixed phased shift angle (0, $\pi/3$, $2\pi/3$, $3\pi/3$), and a scale factor (a so-called "reference signal") which is the output of either circuit 50 or circuit 51 (FIG. 1). For example, the output signal $V_3$ of circuit branch 41 provides a signal which is the product of the signal at terminal 21, attenuated by a factor of $\frac{1}{2}$ in circuit 50, and a factor sin $(\alpha+\pi/3)$. The factor sin $(\alpha+\pi/3)$ is generated by the circuit shown in FIG. 2.

In FIG. 2, reference numeral 92 designates the look-up table for the trigonometric function sin ($\alpha$) for values of $\alpha$ between 0° and 180° (or $\pi$ radians). The input signal ($\alpha$) is increased by the appropriate phase shift angle ($\pi/3$ for the branch 41) and the resulting angle is used as an address for look-up table 92. The digital output signal of look-up table 92 is fed to the digital input of the digital-to-analog converter 94. For reasons of memory economy, we use only half the table of sin ($\alpha$), i.e. 0°–180°. The comparator circuit 98 in combination with circuits 99, 100 and 101 are used to effectively expand the table to 0°–360° by inverting the value of sin $(\alpha+\pi/3)$, where appropriate.

For a person skilled in the art it will be obvious that by the use of time-division multiplexing techniques one single sine table may be used for the several branches 40, 41, 42 and 43.

What is claimed is:

1. A control device for a synchro receiver for data supplied by a synchro transmitter and a digital element, the said synchros each comprising three stator windings, the control device comprising: four circuit branches with inputs of the first and the second branches interconnected to receive a first voltage from a first stator winding of the synchro transmitter and with inputs of the third and the fourth branches interconnected to receive a second voltage from a second stator winding of the synchro, first and second adders, means connecting two inputs of the first adder to outputs of the first and the third branches, respectively, means connecting two inputs of the second adder to outputs of the second and the fourth branches, said first, second, third and fourth branches having a transfer function of the form sin $(\alpha+\phi 1)$, sin $(\alpha+\phi 2)$, sin $(\alpha+\phi 3)$, and sin $(\alpha+\phi 4)$, respectively, wherein $\alpha$ represents the data supplied by the digital element and $\phi 1$, $\phi 2$, $\phi 3$, $\phi 4$ the different phase angles of the first, second, third, and fourth branches, respectively, and means for applying control voltages derived at outputs of the first and second adders to the stator windings of the synchro receiver.

2. A control device for a synchro receiver as claimed in claim 1, wherein the circuit branches each comprise a memory device look-up "sine table" having an input that receives a code signal which depends on the digital data and having an output connected to a digital input of a digital-to-analog converter of a type providing an output voltage proportional to a reference voltage applied to a reference input thereof, the reference input of the digital-to-analog converter being the input of the circuit branch that is connected to a synchro transmitter stator winding and the converter output being the output of the branch circuit that is connected to an input of an adder.

3. A control device for a synchro receiver as claimed in claim 1 wherein the phase angles $\phi 1$, $\phi 2$, $\phi 3$, $\phi 4$ have the values 0, $\pi/3$, $2\pi/3$, $3\pi/3$.

4. A control device for a synchro receiver as claimed in claim 2 wherein the phase angles $\phi 1$, $\phi 2$, $\phi 3$, $\phi 4$ have the values 0, $\pi/3$, $2\pi/3$, $3\pi/3$.

5. A control device for a synchro receiver having three stator windings adapted to be coupled to first and second output terminals of the control device comprising:

first and second input terminals for receiving first and second analog data signals, input means for applying a digital data signal $\alpha$ to first, second, third and fourth circuit branches of the control device, said first, second, third and fourth circuit branches having respective transfer functions of the form sin $(\alpha+\phi 1)$, sin $(\alpha+\phi 2)$, sin $(\alpha+\phi 3)$ and sin $(\alpha+\phi 4)$, wherein $\phi 1$, $\phi 2$, $\phi 3$, and $\phi 4$ represent respective phase shift angles of the first, second, third and fourth circuit branches, means connecting an input of the first circuit branch and an input of the second circuit branch to the first input terminal, means connecting an input of the third circuit branch and an input of the fourth circuit branch to the second input terminal, a first adder circuit having first and second inputs connected to respective outputs of the first and third circuit branches, a second adder circuit having first and second inputs connected to respective outputs of the second and fourth circuit branches, and means for applying control signals produced at outputs of the first and second adder circuits to said first and second output terminals, respectively.

6. A control device as claimed in claim 5, wherein one or more of the circuit branches comprise: a sine table memory device having an input which receives a digital signal determined by the digital data signal $\alpha$ and the respective phase shift angle $\phi$ for said circuit branch, means for coupling a digital output signal of said memory device to a digital input of a digital/analog converter, said digital/analog converter having a reference signal input coupled to an input of the circuit branch, and means coupling an output of the digital-/analog converter to the output of the circuit branch.

7. A control device as claimed in claim 6, wherein said sine table memory device stores data signals for the range 0°–180° of the sine table, said circuit branch further comprising:

means responsive to the digital signal for deriving a further control signal which indicates whether the digital signal at the input of the memory device falls within the interval 0°–180° or within the interval 180°–360°, and switching means responsive to said further control signal for coupling the output of the digital/analog converter to the output of the circuit branch via circuit means that provide a multiplication factor of +1 or −1 depending upon said further control signal.

8. A control device as claimed in claim 5, wherein the phase shift angles $\phi a$, $\phi 2$, $\phi 3$ and $\phi 4$ have the values 0, $\pi/3$, $2\pi/3$ and $3\pi/3$, respectively.

9. A control device as claimed in claim 8, wherein said first and second input terminals are adapted to be connected to stator windings of a synchro transmitter that supplies input signals of the form $V_0 \sin(\theta-\pi/3)$ and $V_0 \sin(\theta-2\pi/3)$ at said first and second input terminals, respectively, where $V_0$ respresents the maximum amplitude of a signal voltage and $\theta$ the angle of rotation of the synchro transmitter rotor, said control device producing respective output signal voltages at said first and second terminals of the form $kV_0 \sin(\alpha-\theta+2\pi/3)$ and $kV_0 \sin(\alpha-\theta+\pi/3)$, where k is a proportionality factor.

* * * * *

UNITED STATES PATENT AND TRADEMARK OFFICE

CERTIFICATE OF CORRECTION

PATENT NO. : 4,598,289

DATED : July 1, 1986

INVENTOR(S) : Guy F.M. Marin et al

It is certified that error appears in the above-identified patent and that said Letters Patent is hereby corrected as shown below:

Column 8, Claim 8, line 2 change "ØA" to --Ø1--

Signed and Sealed this

Seventeenth Day of January, 1989

*Attest:*

DONALD J. QUIGG

*Attesting Officer*

*Commissioner of Patents and Trademarks*